United States Patent [19]

Coward et al.

[11] 4,084,799

[45] Apr. 18, 1978

[54] SHROUDING APPARATUS

[75] Inventors: Michael D. Coward, Georgetown; William J. Dobinski, Myrtle Beach; Rocose M. Hinson, Jr., Pawleys Island, all of S.C.

[73] Assignee: Georgetown Steel Corporation, Georgetown, S.C.

[21] Appl. No.: 718,705

[22] Filed: Aug. 30, 1976

[51] Int. Cl.[2] ..... B22D 11/10; B22D 35/04

[52] U.S. Cl. ..... 266/207; 164/259; 164/415; 164/437; 266/217

[58] Field of Search ..... 164/66, 82, 259, 281, 164/337, 415, 437; 266/207, 217, 236

[56] References Cited

U.S. PATENT DOCUMENTS

| | | | |
|---|---|---|---|
| 3,439,735 | 4/1969 | Holmes | 164/259 |
| 3,616,843 | 11/1971 | Newhall et al. | 164/259 X |
| 3,841,385 | 10/1974 | Burk | 164/66 |
| 3,908,734 | 9/1975 | Pollard | 164/66 |
| 3,963,224 | 6/1976 | Pollard | 164/66 X |

*Primary Examiner*—Francis S. Husar
*Assistant Examiner*—Gus T. Hampilos
*Attorney, Agent, or Firm*—Ralph H. Dougherty

[57] ABSTRACT

A shrouding apparatus protects a molten metal stream from atmospheric contamination by establishing a protective atmosphere around the molten metal stream. The apparatus is held tightly against the vessel from which the stream is poured. The apparatus includes means for elevating and lowering the shroud, means for aligning the shroud with the pouring stream, and means for introducing a protective atmosphere to the interior of the shroud.

13 Claims, 5 Drawing Figures

SHROUDING APPARATUS

BACKGROUND OF THE INVENTION

This invention relates to an improved shrouding apparatus for protecting a molten metal pouring stream from atmospheric reoxidation.

In the continuous casting of molten metals such as steel, molten metal from a ladle is teemed into an intermediate pouring vessel called a tundish positioned above a continuous casting mold. The tundish has a pouring nozzle in its bottom wall. When continuously casting billets, a caster will often have as many as six billet strands issuing from six molds, thus the tundish will require six pouring nozzles.

Atmospheric reoxidation of the steel stream flowing between the tundish and the mold will cause the accumulation and entrapment of undesirable oxide inclusions in each cast billet. Inclusions trapped in the billet render the product cleanliness unacceptable for quality steel grades. To alleviate the problem of reoxidation, various types of shrouds have been developed and used in the continuous casting of steels. Bailey British Patent Specification No. 371,880, Lyman U.S. Pat. No. 3,572,422 and Pollard U.S. Pat. No. 3,908,734 teach shrouding of molten metal pouring streams with inert or reducing gas. Some types of shroud are manufactured from refractory materials and termed "refractory pouring tubes" since they project downward from the bottom of the tundish to beneath the surface of the metal in the mold as shown by Mills, et al U.S. Pat. No. 3,517,726. Alternatively, bellows-type shrouds exist which are attached to both the tundish and the mold, affording a completely enclosed pouring chamber which allows vertical oscillation of the mold. However, neither the stream characteristics nor the metal in the mold can be observed through this bellows-type shroud. Additionally, the bellows-type shroud affords no access to the nozzle. Still other shrouds exist which are mounted on the mold and extends upwards to the tundish. One such shroud is a split cylinder, half of which is removable to provide access to the pouring nozzle as shown in Holmes U.S. Pat. No. 3,439,735.

Although a split shroud affords access to the tundish nozzle, most of the prior art shrouds, including the split shrouds are fixed systems which are not readily removable to accomodate other apparatus beneath the pouring stream such as a launder which, when required, diverts the pouring stream away from the mold. Also, the fixed shroud systems do not allow nozzle cleaning by an oxygen torch during casting nor insertion of a chill plug to stop the flow of the molten metal.

The Pollard patent teaches that the shroud tube must be open at both ends, to afford two-directional gas flow and to allow rapid removal of the shroud from the operating position.

Contrary to the teachings of the Pollard patent, we have determined experimentally that a shroud must be tightly held against the tundish or pouring vessel to prevent entrainment of oxygen from air into the shroud and reoxidation of the steel stream. When a shroud is open at the top, hot air rising off the mold is drawn upwardly through the shroud, exiting at the top, reducing the effectiveness of the inert gas introduced to the interior of the shroud and causing considerable reoxidation of the steel in the pouring stream. When the diameter of a shroud closely approximates the diameter of the pouring stream, the quality of the seal between the shroud tube and the pouring vessel is not as critical as it is when the shroud tube has a diameter in excess of three times the diameter of the pouring stream. However, larger diameter shroud tubes on the order of four inch diameter have more desirable operating characteristics than small diameter tubes, say, of 2½ inch diameter or less. In smaller diameter tubes, splash and spatter from the pouring stream impinges against the inside of the tube causing a buildup of solid steel. In some instances this buildup becomes so severe that it shuts off the pouring stream. In other instances, the buildup is washed out of the tube by action of the pouring stream and into the mold where it can rupture the solidifying shell causing molten steel to "break-out" and necessitating casting of that strand to be terminated. Experimental data shows that the larger diameter tubes require the seal between the shroud tube and the tundish to be as tight as possible to prevent air leakage into the shroud tube from the surrounding atmosphere.

Japanese researchers have determined that the oxygen content of shrouding gas must be maintained at less than 0.8% to prevent the continuous formation of oxide inclusions from reoxidation of the steel stream. In our experimental work, which involved the accurate measurement of shroud and mold environment oxygen concentrations, we determined: first, that a shroud sealed to the tundish has a significantly lower oxygen concentration in the shroud than one with a gap between the top of the shroud and the bottom of the tundish; and second, that as the gap between the bottom of the shroud and the top of the mold is decreased, the oxygen concentration in both the shroud and in the mold decreases significantly.

Therefore, the shroud tube should extend as far as possible downwardly toward the mold, yet allow space between the shroud and mold for viewing the liquid level in the mold. Heretofore, there has been no convenient mechanism for placing a shroud against a tundish and for removing it when necessary in order to divert the pouring stream from the mold. The invented shroud apparatus is readily positionable tightly against the pouring nozzle of a molten metal pouring stream from a bottom-pour vessel, yet is easily and quickly removed to accomodate other apparatus such as a launder beneath the stream.

SUMMARY OF THE INVENTION

A shrouding apparatus for a tundish from which molten metal is teemed into a vertically oscillating mold includes a vertical shroud tube which is tightly held against the bottom of the tundish around the tundish nozzle to form a gas tight seal, means for supplying a protective gas to the interior of the shroud tube, means for rotating the shroud tube into and out of alignment with the tundish nozzle and means for moving the shroud tube axially into and out of operating position against the bottom of the tundish.

OBJECTS OF THE INVENTION

It is the principal object of this invention to provide a shrouding apparatus to protect from atmospheric contamination a molten metal pouring stream teemed from a bottom-pour vessel such as a tundish into a mold.

It is also an object of this invention to provide a shrouding apparatus which is not connected to either a tundish or a mold yet is readily positionable against the bottom of a tundish with a gas tight seal.

It is another object of this invention to provide an independently mounted shrouding apparatus.

It is a further object of this invention to provide a shrouding apparatus which is quickly and easily removed from its operating position beneath a tundish to accommodate other apparatus.

It is also an object of this invention to provide a shrouding apparatus which is simple and inexpensive with easily replaceable parts.

It is another object of this invention to provide a shrouding apparatus which automatically pivots out of alignment with its associated pouring stream when released from its operating position.

These and other objects will become more readily apparent by referring to the following detailed specification and the appended drawings. In the drawings.

DETAILED DESCRIPTION

Figure 1:
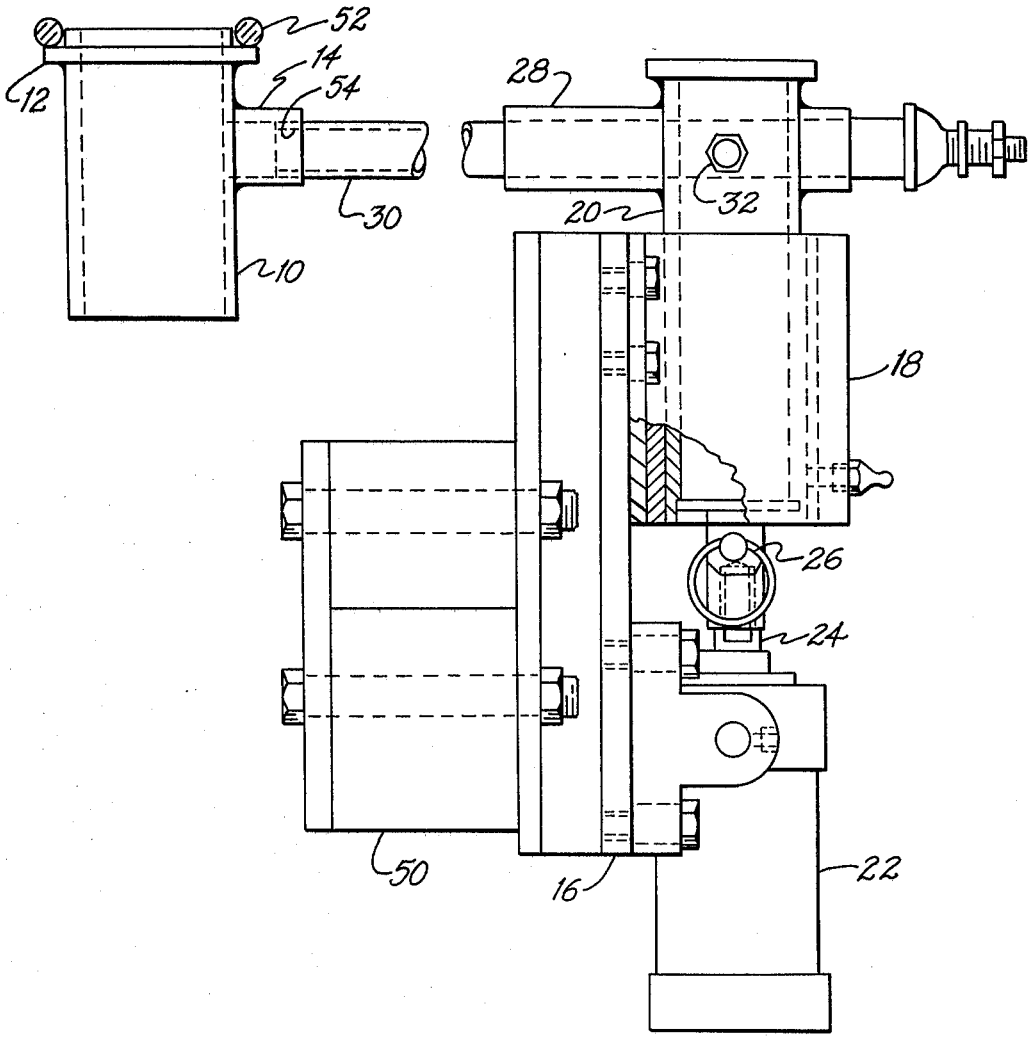
FIG. 1 is a side elevational view of the invented shroud apparatus.
Figure 2:
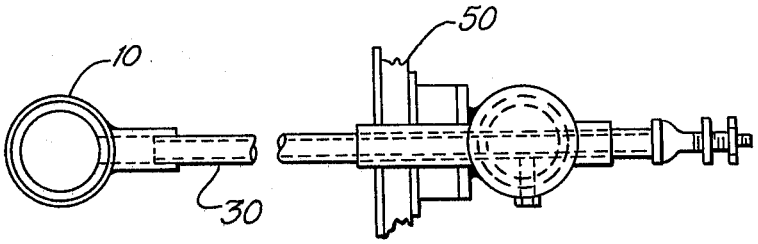
FIG. 2 is a top view of the shroud apparatus.

Referring now to the drawings, shroud tube 10, best shown in FIG. 1, is preferably a hollow cylinder carrying an external gasket seat 12 at its upper end and a gas conduit 14 on its side for conducting shrouding gas such as nitrogen, argon or any other suitable protective gas to the interior of the shroud. The gas conduit 14 can also serve as the shroud support member.

The shroud apparatus is mounted on a fixed base 16 which is usually attached to the tundish car or pouring platform or maybe the casting floor. Pivot pin housing 18 fixed to base 16 is vertically mounted for receiving pivot pin 20 therein. Pivot pin 20 is vertically movable within housing 18 by means of pneumatic cylinder 22. Cylinder 22 is anchored to fixed base 16 and carries a piston 24 connected to the lower end of pivot pin 20 by any suitable means such as a quick release pin 26.

The upper end of pivot pin 20 carries a sleeve 28 which is adapted for carrying longitudinally movable shroud tube support arm 30 therein, which support arm also acts as a gas conduit connecting with gas conduit 14. A set screw 32 in sleeve 28 prevents rotation and logitudinal movement of support arm 30 in sleeve 28, thus holding shroud tube 10 in the desired relationship with pivot pin 20 when set screw 32 is tightened. Sleeve 28 is preferably horizontally oriented as shown in the drawings, but may be inclined if desired.

Figure 3:
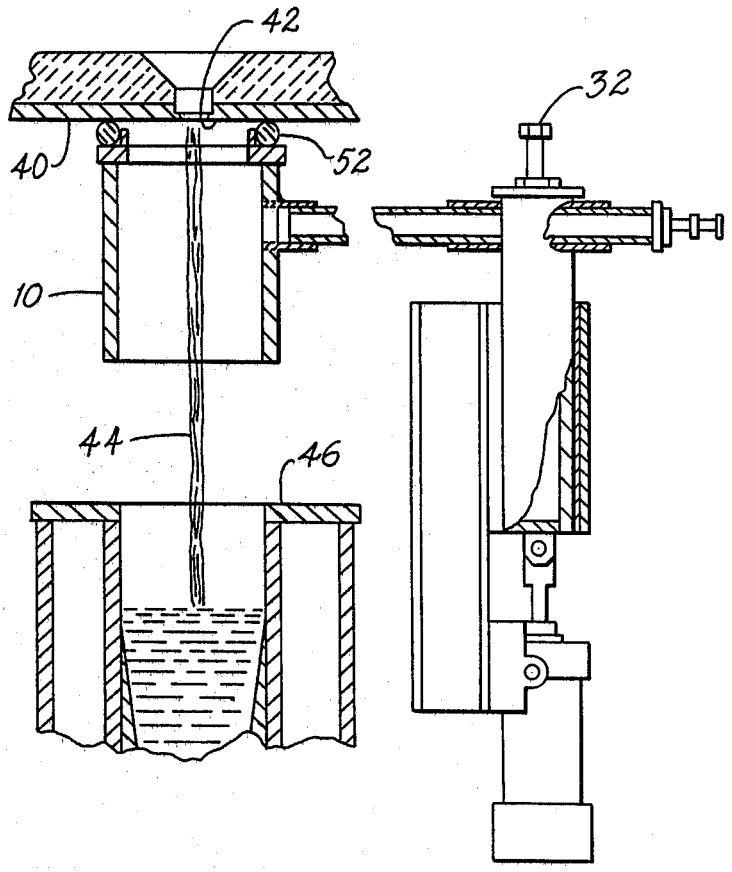
FIG. 3 is an elevational view of a tundish and mold showing the location of the invented shroud apparatus in the operating position.

As seen in FIG. 3, tundish 40 carries nozzle 42 through which a pouring stream of molten metal 44 discharges into mold 46. The invented shrouding apparatus including shroud tube 10 is in the stand-by position on tundish car frame 50 or on the casting floor. The distance between the axis of shroud tube 10 and the pivotal axis of pivot pin 20 is determined by placing the shroud over the nozzle prior to beginning the pouring process.

Figure 4:
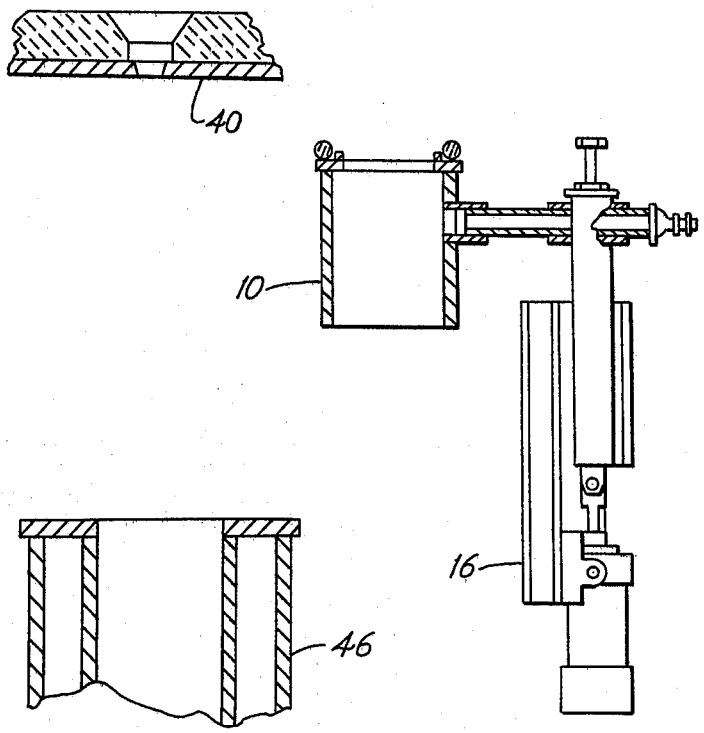
FIG. 4 is an elevational view of tundish and mold similar to FIG. 3 showing the shroud apparatus in the stand-by position.

In operation, the pouring stream is opened, often by oxygen lancing, nitrogen flow is begun to the shroud tube 10, the shroud tube is swung from the stand-by position of FIG. 4 passing through the steel stream and into alignment with the nozzle by pivoting it about the vertical axis of pivot pin 20, then pneumatic cylinder 22 is actuated to move the shroud tube rapidly upwardly against the bottom of the tundish to effect a gas tight seal. Compressible heat resistant material such as asbestos rope is used for the gasket 52. The flow of protective gas through gas conduits 14 and shroud tube support arm 30 fills shroud tube 10, exiting the bottom of the shroud tube from which it is directed downwardly into the top of the mold affording a protective atmosphere to the molten metal in the mold.

Upon a breakout occurring farther down in the mold, or some other emergency situation, rendering it desirable to temporarily shut down one pouring stream, the piston in the pneumatic cylinder 22 is rapidly retracted, lowering the shroud tube which is then pivoted about pin 20 either manually or automatically, clearing the region beneath the nozzle for accomodation of a launder or of a chill plug or any other desired apparatus.

In the usual emergency situation, the shroud tube is lowered by actuation of cylinder 22, then pushed out of alignment beneath the nozzle by the launder as the launder is positioned under the steel stream. In this manner, removal of the shrouding apparatus from the operating mode requires very little time, which is important in the case of an emergency when the launder has to be positioned quickly under the steel stream to prevent damage to mill equipment.

Each part of the shrouding apparatus is readily replaceable. The shroud tube 10 may be connected to shroud tube support arm 30 by a threaded connection 54, as the shroud tube is the most easily damaged part of the apparatus, being used in a region of continuous exposure to molten steel splash and spatter.

Figure 5:
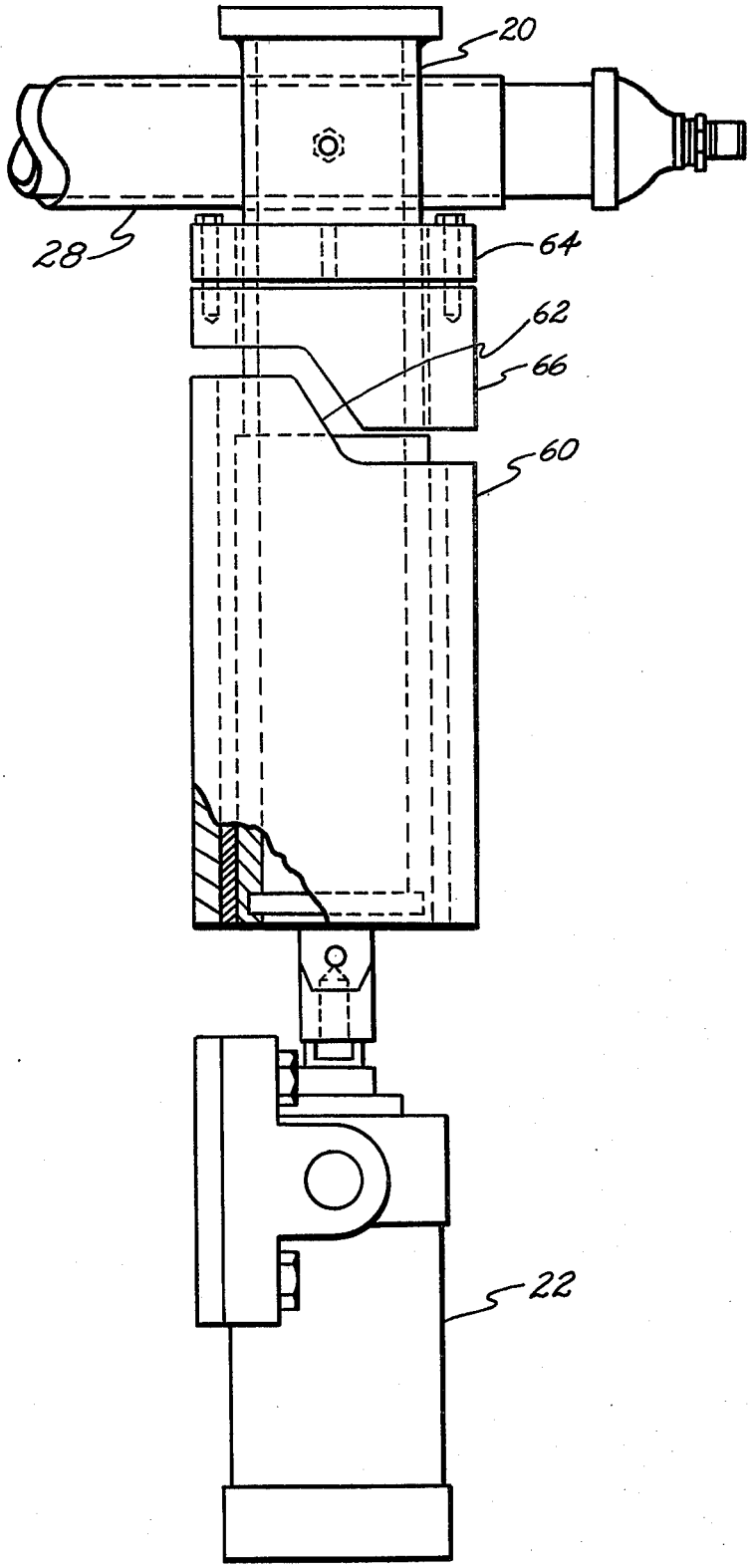
FIG. 5 is an elevational view of an alternative support apparatus for a shroud, which allows automatic pivoting of the shroud down and away from the operating position around the pouring stream.

An alternative embodiment shown in FIG. 5 features a pivot pin housing 60 having an inclined upper surface 62. Housing 60 is fixed into position in the same manner as housing 18 of FIG. 1. The upper end of pivot pin 20 beneath sleeve 28 carries a clutch assembly 64. Suitable clutch assemblies are manufactured by Formsprag Company of Warren, Mich. The clutch 64 is connected to collar 66 and is engageable and disengageable with pivot pin 20. After the shroud is placed into position, clutch 64 is disengaged from the pin 20, rotated a few degrees in one direction, then re-engaged. Upon pneumatic cylinder 22 being actuated, the shroud is lowered but when the inclined bottom surface 68 of collar 66 strikes the inclined surface 62 of housing 60, the shroud turns until the inclined portions are mated, moving the shroud a desired arcuate distance from its operating location. Alternatively, collar 66 and housing 60 could have a completely inclined end surface with the same operating results, or a pin could be fixed to either collar 66 or sleeve 60 with the other member having an inclined surface which would contact the pin upon lowering of the shroud, thus rotating the shroud support and the shroud in the same manner.

It is readily apparent from the foregoing that the present invention provides an apparatus for protecting a molten metal pouring stream from atmospheric contamination which apparatus is quickly and easily positioned for operation and just as quickly and easily removed from its active position to accommodate other apparatus beneath the pouring nozzle of the vessel.

What is claimed is:

1. A shrouding apparatus for protecting the liquid stream issuing from the bottom of a tundish comprising:
(a) a shroud tube having a vertically oriented longitudinal axis;
(b) means connected to said shroud tube for aligning the axis of said shroud tube with said liquid stream, said means comprising;
(1) a base,
(2) a pivot means housing connected to said base,
(3) pivot means housed in said pivot means housing,
(4) a shroud tube support arm sleeve carried by said pivot means,
(5) a shroud tube support arm longitudinally movable in said shroud tube support arm sleeve, and
(6) retaining means carried by said sleeve and engageable with said support arm for maintaining said support arm in proper orientation;
(c) means connected to said shroud tube for raising and lowering said tube into and out of contact with said tundish;
(d) sealing means between said shroud tube and said tundish capable of creating a substantially gas tight seal; and
(e) means communicating with said shroud tube for introducing gas to the interior of said shroud tube.

2. Apparatus according to claim 1 wherein said retaining means is a set screw.

3. Apparatus according to claim 1 wherein said means for raising and lowering said shroud tube comrises a pneumatic cylinder connected to said base and to said shroud tube support arm.

4. Apparatus according to claim 1 wherein said sealing means comprises a ring of compressable heat resistant material between said shroud tube and the bottom of said tundish.

5. Apparatus according to claim 4 wherein said sealing material is asbestos rope.

6. Apparatus according to claim 1 wherein said gas introducing means comprises a gas conduit carried by said support arm and communicating with a source of protective gas and with the interior of said shroud tube.

7. Apparatus according to claim 6 wherein said gas conduit is within said support arm.

8. Apparatus according to claim 1 wherein said shroud tube is connected to said shroud tube support arm by a threaded connection.

9. Apparatus according to claim 1 wherein said pivot means is horizontally spaced from said shroud tube, said apparatus further comprising means for moving said shroud tube arcuately about said pivot means as said shroud tube is lowered.

10. Apparatus according to claim 9 wherein said means for moving said shroud tube arcuately comprises a pair of mating incline surfaces associated with said pivot means for rotating said pivot means selectively.

11. A shrouding apparatus for protecting the liquid stream issuing from the bottom of a tundish comprising:
(a) a shroud tube having a vertically oriented longitudinal axis;
(b) means connected to said shroud tube for aligning the axis of said shroud tube with said liquid stream, comprising;
(1) a base,
(2) pivot means housing connected to said base,
(3) pivot means housed in said pivot means housing,
(4) a shroud tube support arm sleeve carried by said pivot means,
(5) a shroud tube support arm longitudinally moveable in said shroud tube support arm sleeve,
(6) retaining means carried by said sleeve and engageable with said support arm for maintaining said support arm in proper orientation, and
(7) a collar engageable with said pivot means and means at the upper end of said pivot means housing for contacting the bottom of said collar to rotate it and said shroud simultaneously;
(c) means connected to said shroud tube for raising and lowering said tube into and out of contact with said tundish;
(d) sealing means between said shroud tube and said tundish for creating a substantially gas tight seal; and
(e) means communicating with said shroud tube for introducing gas to the interior of said shroud tube.

12. Apparatus according to claim 11 wherein said collar has an inclined bottom surface and said pivot means housing has an inclined upper surface.

13. Apparatus according to claim 12 wherein said collar is connected to a clutch which is engageable and disengageable from said pivot means.

* * * * *

UNITED STATES PATENT AND TRADEMARK OFFICE

CERTIFICATE OF CORRECTION

PATENT NO. : 4,084,799
DATED : Apr. 18, 1978
INVENTOR(S) : Michael D. Coward
William J. Dobinski
Roscoe M. Hinson, Jr.

It is certified that error appears in the above-identified patent and that said Letters Patent are hereby corrected as shown below:

Item 75 should read as follows:

--Inventors: Michael D. Coward, Georgetown;
William J. Dobinski, Myrtle Beach;
Roscoe M. Hinson, Jr., Pawleys
Island, all of S.C.--

Column 5, line 33, delete "comrises" and substitute therefor

--comprises--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*